US005476598A

United States Patent [19]

Schramm, Jr. et al.

[11] Patent Number: 5,476,598

[45] Date of Patent: Dec. 19, 1995

[54] LIQUID FABRIC SOFTENING COMPOSITION CONTAINING AMIDOAMINE SOFTENING COMPOUND

[75] Inventors: Charles J. Schramm, Jr., Neshanic, N.J.; Regis Cesar, Villers le Bouillet, Belgium

[73] Assignee: Colgate-Palmolive Co., New York, N.Y.

[21] Appl. No.: 350,510

[22] Filed: Dec. 6, 1994

Related U.S. Application Data

[63] Continuation of Ser. No. 995,102, Dec. 22, 1992, abandoned.

[51] Int. Cl.[6] ..... D06M 13/325; D06M 13/328

[52] U.S. Cl. ..... 252/8.8; 252/8.6; 252/8.9; 252/542; 252/544; 252/548

[58] Field of Search ..... 252/8.8, 8.6, 8.9, 252/544, 548, 542

[56] References Cited

U.S. PATENT DOCUMENTS

| | | | |
|---|---|---|---|
| 3,904,539 | 9/1975 | Ramachandran | 8/137 |
| 3,954,630 | 5/1976 | Ramachandran | 252/8.8 |
| 4,399,045 | 8/1983 | Burns | 252/8.75 |
| 4,555,349 | 11/1985 | Butterworth et al. | 252/8.6 |
| 4,671,884 | 6/1987 | McKinnon et al. | 252/8.8 |
| 4,724,089 | 2/1988 | Konig et al. | 252/8.8 |
| 4,772,403 | 9/1988 | Grandmaire et al. | 252/8.8 |
| 4,772,404 | 9/1988 | Fox et al. | 252/8.8 |
| 4,965,100 | 10/1990 | Leigh et al. | 427/242 |
| 4,999,121 | 3/1991 | De Block et al. | 252/8.8 |
| 5,009,800 | 4/1991 | Foster | 252/8.9 |
| 5,061,385 | 10/1991 | Duffin | 252/8.8 |
| 5,108,628 | 4/1992 | Uphues et al. | 252/8.6 |
| 5,128,055 | 7/1992 | Foster | 252/8.9 |
| 5,133,885 | 7/1992 | Contor et al. | 252/8.6 |
| 5,154,838 | 10/1992 | Yamamura et al. | 252/8.6 |
| 5,160,641 | 11/1992 | Foster | 252/8.6 |
| 5,180,508 | 1/1993 | Birkhan et al. | 252/8.8 |
| 5,234,611 | 8/1993 | Trinh et al. | 252/8.8 |
| 5,242,607 | 8/1993 | Yamamura et al. | 252/8.6 |
| 5,282,983 | 2/1994 | Yamamura et al. | 252/8.6 |
| 5,288,847 | 2/1994 | Harmalker et al. | 232/8.8 |

FOREIGN PATENT DOCUMENTS

| | | |
|---|---|---|
| 0038862 | 11/1981 | European Pat. Off. . |
| 0128231 | 12/1984 | European Pat. Off. . |
| 0340872 | 11/1989 | European Pat. Off. . |
| 0423894 | 4/1991 | European Pat. Off. . |
| 0459211 | 12/1991 | European Pat. Off. . |
| 221741 | 8/1990 | Japan . |

*Primary Examiner*—Linda Skaling Therkorn
*Assistant Examiner*—Michael P. Tierney
*Attorney, Agent, or Firm*—Bernard Lieberman; Robert C. Sullivan; Henry S. Goldfine

[57] ABSTRACT

The stability and softening performance of amidoamine fabric softeners, such as bis(hydrogenated tallow amidoethyl)-2-hydroxyethyl amine) is improved by protonating the amine with a neutralizing inorganic or organic acid and incorporating certain stabilizing emulsifiers, such as, N,N', N'-tris(2-hydroxyethyl)-N-tallow-1,3-diaminopropane, dimethylhydrogenated tallow amine, methyl dihydrogenated tallow amine, and oleic imidazoline). Mixtures of bis(hydrogenated tallow amidoethyl)-2-hydroxyethyl amine and bis(tallow amidoethyl)-2-hydroxyethyl amine also provide improved softening and form stable aqueous dispersions. The compositions may be highly concentrated for use at low levels or for further dilution prior to use.

20 Claims, No Drawings

LIQUID FABRIC SOFTENING COMPOSITION CONTAINING AMIDOAMINE SOFTENING COMPOUND

This is a continuation of U.S. application Ser. No. 07/995,102 filed Dec. 22, 1992, now abandoned.

FIELD OF THE INVENTION

This invention relates to liquid fabric softening compositions. More particularly, the invention relates to ready-for-use and concentrated liquid fabric softening compositions which are effective in softening fabrics in both soft and hard water and which are primarily intended as rinse cycle fabric softening compositions.

BACKGROUND OF THE INVENTION

Compositions containing quaternary ammonium salts or imidazolinium compounds having at least one long chain hydrocarbyl group are commonly used to provide fabric softening benefits when used in a laundry rinse operation. Numerous patents have been issued for these types of compounds and compositions.

More recently, however, in view of concerns for the environmental safety (e.g., biodegradability) of the quaternary compound softeners, as well as limits in the amounts of these cationic compounds which can be stably incorporated into the more convenient to use liquid formulations, there have been many proposals for partial or total replacements for the conventional "quat" fabric softeners which are exemplified by dimethyl distearyl (or ditallow) ammonium chloride and various imidazolinium compounds.

For instance in GB 2,032,479A, corresponding to EP 038862, to D. Fontanesi (assigned to Albright & Wilson Ltd.) water dispersible unquaternized hydroxyalkyl diamidoamine compounds of formula $$RNH((CH_2)_nNR)_mR$$

wherein an average of from 20% to 80% of the R groups are $C_{12}$ to $C_{22}$ acyl, at least 20% of the R groups are $—CH_2CH_2OH$ or $—CH_2CHOHCH_3$ or mixtures of these groups, and any other R group is hydrogen, n is 2 or 3 and m is an integer of from 2 to 5, can be obtained as usable pastes in the presence of lower alkanol solvents. This is stated to be in contrast to partially neutralized unquaternized diamidoamines which, while providing highly effective fabric softening properties, are too viscous even when diluted in the lower alkanol solvents for convenient handling.

U.S. Pat. No. 5,154,838 (corresponding to EP 0459211A2) to Yamamura, et al. (assigned to Kao Corp. ) discloses an aqueous liquid softener composition based on an amidoamine compound which is the condensation reaction product of a di- or tri-amine of formula (I)

$$R^1NH(C_mH_{2m}NH)_nH \qquad (I)$$

with a fatty acid of formula (II)

$$R^2\underset{\underset{O}{\|}}{C}—OH \qquad (II)$$

wherein $R^1$ represents a straight or branched chain, saturated or unsaturated hydrocarbon group having 8 to 24 carbon atoms, $R^2$ represents a straight or branched, saturated or unsaturated hydrocarbon group having 7 to 23 carbon atoms, m represents 2 or 3, and n is 1 or 2. These compounds, which are neither hydroxylated or ethoxylated, are noted to have high dispersibility in rinse water, especially when the amidoamine compound is used in the form of its neutral salt.

In U.S. Pat. No. 5,133,885 to L. Contor, et al. (assigned to Colgate-Palmolive Co., the assignee of the present invention) fabric softening compositions are described which are aqueous dispersions of a fatty acid ester quat of formula

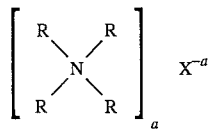

where one or two R groups represent an aliphatic ester residue of from 12 to 30 carbon atoms of formula $-(CH_2—)_nOCOR_4$, and the remaining R groups represent lower aliphatic, aralkyl or hydroxyalkyl groups, $X^-$ is an anion and "a" represents the ionic valence of the anion, and a fatty acid amidoamine softener of formula $$R^1CONH(CH_2)_mN(R^2)—R^3$$

where $R^1$ is a $C_{12}$ to $C_{30}$ alkyl or alkenyl group, $R^2$ represents $R^1$,$R^1CONH(CH_2)_m$ or $CH_2CH_2OH$; $R^3$ represents hydrogen, methyl, or $(CH_2CH_2O)_pH$, m is a number of 1 to 5 and p is a number of 1 to 5, at a weight ratio of ester quat to amidoamine of from 10:1 to 1:10.

U.S. Pat. No. 4,772,403 to Grandmaire, et al. (Colgate-Palmolive Co.) discloses aqueous fabric softening compositions, especially adapted for use in the rinse cycle of a laundering process. These compounds are based upon (i) cationic fabric softening compounds and (ii) fatty alcohol having an alkyl group of from about 10 to about 22 carbon atoms at an (i)=(ii) weight ratio of from 6:1 to about 2.8:1, and a total amount of (i) and (ii) of 3 to 20 weight percent. A minor amount of water soluble electrolyte and/or an ethoxylated amine can be used as optional ingredients, the latter as an emulsifier to further increase the stability against phase separation of the suspended phase of the formulation.

U.S. Pat. No. 5,108,628 to Uphues, et al. (Henkel) discloses certain aliphatic carboxylic acid amidoamines which are obtained by reaction of polyamines (e.g., diethylentriamine, aminoethyl ethanolamine) with carboxylic acid mixtures containing ether carboxylic acids ($R—O—(CH_2CH_2O)_n—CH_2COOH$, $R=C_{8-18}$ alkyl, $C_{8-18}$ alkenyl or $CH_2—COOH$, n=2 to 20, in combination with aliphatic $C_{8-22}$ monocarboxylic acids and/or amide-forming aliphatic $C_{8-22}$ monocarboxylic acid derivatives) as fabric softeners stable in the presence of electrolytes.

While these and many other proposals are known for improved fabric softening compositions, nevertheless, still further improvements are desired.

SUMMARY OF THE INVENTION

Accordingly, the present invention provides stable, aqueous, pourable and water dispersible, fabric softener compositions which include (A) a fabric softening effective amount of an inorganic or organic acid salt of a finely divided softening compound of formula (I):

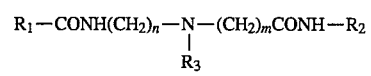

$$R_1-CONH(CH_2)_n-\underset{\underset{R_3}{|}}{N}-(CH_2)_mCONH-R_2 \quad (I)$$

wherein $R_1$ and $R_2$, independently, represent $C_{12}$ to $C_{20}$ alkyl or alkenyl; $R_3$ represents $(CH_2CH_2O)_pH$, $CH_3$ or H; n and m are each a number of from 1 to 5; and p is a number of from 1 to 10; (B) a dispersant stabilizing effective amount of a dispersant having the formula (II), (III), (IV) or (V):

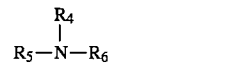

$$R_5-\overset{\overset{R_4}{|}}{N}-R_6 \quad (II)$$

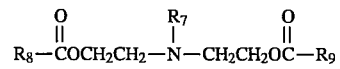

$$R_8-\overset{\overset{O}{||}}{C}OCH_2CH_2-\overset{\overset{R_7}{|}}{N}-CH_2CH_2O\overset{\overset{O}{||}}{C}-R_9 \quad (III)$$

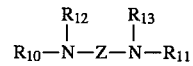

$$R_{10}-\overset{\overset{R_{12}}{|}}{N}-Z-\overset{\overset{R_{13}}{|}}{N}-R_{11} \quad (IV)$$

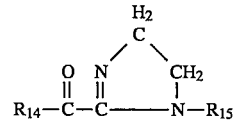

(V)

wherein $R_4$ represents a hydrocarbon group having from 8 to 22 carbon atoms, $R_5$ represents a hydrocarbon group having from 1 to 22 carbon atoms, $R_6$ represents $C_1$–$C_4$ alkyl or hydroxyalkyl, $R_7$ represents $C_1$–$C_4$ alkyl or hydroxyalkyl, $R_8$ and $R_9$ each, independently represent a hydrocarbon group having from 8 to 22 carbon atoms, $R_{10}$ represents a hydrocarbon group having from 8 to 22 carbon atoms, $R_{11}$ represents a hydrocarbon group having from 1 to 22 carbon atoms which may have an hydroxyl group substituent, $R_{12}$ and $R_{13}$, independently, represent $C_1$–$C_4$ alkyl or hydroxyalkyl, Z represents a divalent alkylene group of from 1 to 6 carbon atoms, or an hydroxyl substituted alkylene group;

$R_{14}$ represents a hydrocarbon group having from 8 to 22 carbon atoms;

$R_{15}$ represents a hydrogen atom or $C_1$–$C_4$ alkyl or hydroxyalkyl; and (C) an aqueous solvent.

These compositions may be provided as ready-to-use products or as concentrates to be used at reduced levels or which may be diluted with water prior to use at the same or similar levels as the ready-to-use products. In the ready-to-use composition the total amount of amidoamine softener (A) and stabilizing dispersant (B) is generally in the range of from about 2 to 8% by weight. In the concentrated form the total amount of (A) and (B) is generally in the range of from about 12 to 60% and may be diluted at ratios of water:concentrate as high as about 4:1 to even 8:1 or 9:1, and still provide acceptable softening performance, equivalent or better than that achieved using conventional quaternary cationic surfactant softeners, such as dimethyl distearyl ammonium chloride (DMDSAC).

An especially preferred composition according to the invention (in terms of a ready-to-use formula or diluted concentrate) includes the following ingredients:

(A) from about 2 to 8% by weight of a salt of bis(hydrogenated tallow amidoethyl)-2-hydroxyethyl amine;

(B) from about 0.2 to 1.5% by weight of a stabilizing dispersant compound selected from dimethyl hydrogenated tallow amine, methyl dihydrogenated tallow amine, N,N'N'-tris(2-hydroxyethyl)-N-tallow- 1,3-diaminopropane, and oleic imidazoline;

(C) from about 0.5 to 5% of $C_2H_5OH$, $C_3H_7OH$, or mixture thereof;

(D) 0 to about 2% of $C_6$ to $C_{16}$ fatty alcohol; and (E) from about 87 to 94% water; the composition having a pH of less than 4.

In an alternative embodiment of the invention fabric softener aqueous liquid compositions adaptable for use in the rinse cycle of a laundering process are provided which are stable, pourable, and dispersible in water, and which include the following ingredients:

(A') an inorganic or organic acid salt of bis(hydrogenated tallow amidoethyl) hydroxyethyl amine, (B') an inorganic or organic acid salt of bis(non-hydrogenated tallow amidoethyl) hydroxyethyl amine, with the total amount of (A') and (B') being from about 2% to about 50% by weight of the composition, and the ratio by weight of (A') to (B') being in the range of from about 10:1 to abut 1.5:1, and an aqueous solvent.

The compositions of these embodiments may also include minor amounts of usual additives, such as perfume, preservatives, coloring agents and the like. These compositions will have acidic pH's in the range of from about 1.5 to 4.

DETAILED DESCRIPTION AND PREFERRED EMBODIMENTS

The present invention was developed based on an extensive research program to evaluate available fabric softening compounds which do not pose the risk of, or at least reduce the risk of, causing environmental damage associated with conventional cationic quat fabric softeners such as DMDSAC yet which offer equivalent or superior softening performance to DMDSAC and which are amenable for use in concentrated products. The latter requirement is important in view of the trend in the industry to sell concentrated products which require less packaging and lower shipping costs on a per unit or per usage basis and, therefore, can be characterized as environmentally and user friendly.

As a result of this extensive research it was found that the class of amidoamines, and particularly fatty amidotertiary amines of the foregoing formula (I), which are included in the definition of the amidoamine compounds disclosed in the aforementioned U.S. Pat. No. 5,133,885, and which are commercially available, for example, under the Varisoft trademark from Sherex Chemical Co., when provided in the form of its acid (protonated) complex, met the objectives of high efficacy softening performance and environmental acceptability.

Although not wishing to be bound by any particular theory of operation it is believed that the good softening performance is due to the excellent inherent dispersibility of the finely divided amidoamine softener when the compound is protonated as its acid complex. Such excellent inherent dispersibility is believed to result from the presence of the diamido amine hydrophilic group, which may be further enhanced by a moderate level of ethoxylation (e.g., when $R_3$ represents $(CH_2CH_2O)_pH$). On the other hand, the presence of the two long chain hydrocarbon groups ($C_8$–$C_{20}$ alkyl or alkenyl) contribute to effective fabric softening.

However, the performance of the fatty amido tertiary amine fabric softeners of formula (I) was found to be less effective in hard water than in soft water. It is presumed that this poorer performance may result from the hardness ions in the rinse water causing agglomeration of the fabric softener particles or otherwise inhibiting deposition of the fabric softener on the fabric being treated. Moreover, improvements in storage stability, as measured by absence of phase separation under a wide range of temperature conditions, were desired.

While it has been known in the past that stability against phase separation of aqueous dispersions of finely divided substances, including fabric softening or other fabric treating agents, may be improved by incorporating certain dispersing aides, co-surfactants, emulsifiers, and the like, into the aqueous dispersions, the art has not provided any general guidelines or principles for determining which of the myriad possible candidate compounds would be able to provide the desired improvement in stability, much less improvement in softening performance, especially in hard water, and not only for ready-to-use products, but also for concentrated products.

The present inventors have found that the known cationic emulsifying agents of the formula (II), (III), (IV) and (V) when added in minor amounts to an aqueous dispersion of the fatty amide tertiary amine compounds of the formula (I) will increase stability of the aqueous dispersion without impairing, and often improving, softening performance. Furthermore, these classes of dispersant/emulsifiers allow the compositions to be formulated as concentrates for subsequent dilution at ratios as high as 8:1 or higher, while still remaining pourable in the concentrated form, but not unduly watery in the diluted form.

Thus, the compositions of this invention are stable, aqueous, pourable, and water dispersible compositions which contain, as the active fabric softening compound an inorganic or organic acid salt of fatty amido tertiary amines of formula (I) and a dispersant stabilizing effective amount of certain classes of cationic emulsifier-dispersants, namely compounds of formulas (II), (III), (IV) or (V).

The fabric softening active compound is an amidoamine of formula (I):

$$R_1-\overset{\overset{\displaystyle O}{\|}}{C}-\overset{\overset{\displaystyle H}{|}}{N}(CH_2)_n\overset{\overset{\displaystyle R_3}{|}}{N}(CH_2)_m\overset{\overset{\displaystyle H}{|}}{N}-\overset{\overset{\displaystyle O}{\|}}{C}-R_2 \qquad (I)$$

In the above formula $R_1$ and $R_2$ are each, independently, long chain alkyl or alkenyl groups having from 8 to 22 carbon atoms, preferably from 10 to 18 carbon atoms, such as, for example, octyl, octenyl, decyl, decenyl, dodecyl, dodecenyl, octadecyl, octadecenyl. Typically, $R_1$ and $R_2$, and more generally $R_1$—CO— and $R_2$—CO, will be derived from natural oils containing fatty acids or fatty acid mixtures, such as coconut oil, palm oil, tallow, rape oil, and fish oil. Chemically synthesized fatty acids are also usable. The saturated fatty acids or fatty acid mixtures, and especially hydrogenated tallow (H-tallow) acid (also referred to as hard tallow), are preferred. Generally and preferably $R_1$ and $R_2$ are derived from the same fatty acid or fatty acid mixture.

$R_3$ represents $(CH_2CH_2O)_pH$, $CH_3$ or H, or mixtures thereof may also be present. When $R_3$ represents the preferred $(CH_2CH_2O)_pH$ group, p is a positive number representing the average degree of ethoxylation, and is preferably from 1 to 10, especially 1.5 to 6, and most preferably from about 2 to 4, such as 2.5. n and m are each integers of from 1 to 5, preferably 2 to 4, especially 2. The compounds of formula (I) in which $R_3$ represents the preferred $(CH_2CH_2O)_pH$ group are broadly referred to herein as ethoxylated amidoamines, and the term "hydroxyethyl" is also used to describe the $(CH_2CH_2O)_pH$ group.

Most especially preferred is the compound of formula (I) which is commercially available under the tradename Varisoft 510, available from Sherex Chemical Company, which is bis(hydrogenated tallow-amidoethyl)-hydroxyethyl amine of formula $$(\text{H-tallow-}\overset{\overset{\displaystyle O}{\|}}{C}-NH-CH_2CH_2)_2-N-(CH_2CH_2O)_{2.5}H.$$

In place of the Varisoft 510, or in combination therewith, the corresponding soft (non-hydrogenated) tallow derivative, available from Sherex as Varisoft 512, may be used. Varisoft 512 is ethoxylated with 3.5 moles, on average, rather than 2.5 moles EO as in Varisoft 510. The softening performance of the hard tallow derivative is somewhat better than that of the soft tallow, however, in concentrated formulas Varisoft 512 is useful as providing lower viscosities.

However, in another aspect of the invention it has been found that when Varisoft 510 and Varisoft 512 are used in admixture, preferably at ratios of about 10:1 to about 1.5:1, preferably from 8:1 to 2:1, especially 6:1 to 3:1, both softening performance and stability are improved, even in the absence of the additional emulsifying dispersant (B). That is, in this particular embodiment of the invention the soft tallow amido amine compound is believed to exert a similar function to the emulsifying dispersant (B).

Therefore, the present invention also provides aqueous, stable, pourable, and water dispersible fabric softening compositions which are dispersions in an aqueous solvent of from about 2 to 60% by weight of the composition of (A') inorganic or organic acid salt of bis(hydrogenated tallow amidoethyl) hydroxyethyl amine and (B') inorganic or organic acid salt of bis(tallow amidoethyl) hydroxyethyl amine, at a weight ratio of (A'):(B') of from about 10:1 to 1.5:1 the balance being essentially water, optionally with minor amounts, up to about 8% of the composition of a lower alcohol, e.g., ethanol, propanol, isopropanol, as co-solvent, and minor amounts of usual adjuvants, such as perfume, preservatives, coloring agent, and the like, the composition having a pH in the range of from about 1.5 to 4.

In the non-neutralized (non-protonated) form the amidoamine compounds are hardly or not at all dispersible in water. Therefore, in the present invention, the amine function of the amidoamine compound is at least partially neutralized by a proton contributed by a dissociable acid, which may be inorganic, e.g., HCl, $H_2SO_4$, $HNO_3$, etc. or organic, e.g., acetic acid, propionic acid, lactic acid, citric acid, glycolic acid, toluene sulfonic acid, maleic acid, fumaric acid, and the like. Mixtures of these acids may also be used, as may any other acid capable of neutralizing the amine function. The acid neutralized compound is believed to form a reversible complex, that is, the bond between the amine function and proton will disappear under alkaline pH conditions. This is in contrast to quaternization, e.g., with a methyl group, wherein the quaternizing group is covalently bonded to the positively charged amine nitrogen and is essentially pH independent. The compositions of this invention are preferably substantially free of quaternized compounds, such as the fatty acid ester quats in U.S. Pat. No. 5,133,885.

The amount of acid used will depend on the "strength" of the acid; strong acids such as HCl, and $H_2SO_4$ completely dissociate in water and, therefore, provide a high amount of free protons ($H^+$), while weaker acids, such as citric acid, glycolic acid, lactic acid, and other organic acids, do not dissociate completely and, therefore, require a higher concentration to achieve the same neutralizing effect. Generally, however, the amount of acid required to achieve complete protonation of the amine, will be achieved when the pH of the composition is rendered strongly acidic, namely between about 1.5 and 4. HCl and glycolic acid are preferred, and HCl is especially preferred.

Furthermore, the amount of acid used for neutralization should be sufficient to provide at least an 0.5:1 molar ratio, and up to about a 1:1 molar ratio of the acid to the total amount of fabric softener amidoamine(s). For the organic carboxylic acids, however, and especially in the concentrated compositions containing at least 12 weight percent, preferably at least 20 wt %, such as 20 to 50 wt %, especially 35 to 45 wt % of active softener and dispersant stabilizer compounds, it is preferred to use a molar excess of the neutralizing acid. Molar ratios of organic carboxylic acid to amidoamine up to about 6:1, for example from 1.5:1 to 6:1, such as 2:1, 3:1 or 4:1, have been found advantageous in terms of stability and/or softening performance. The use of glycolic acid in molar excess is especially preferred.

However, it has also been found that partially neutralized ethoxylated amidoamines are highly stable. Therefore, in some cases molar ratios of acid (as HCl) to ethoxylated amido amine of formula (I) of from 0.5:1 to about 0.95:1, such as 0.6:1 and 0.7:1, can be advantageously used. For the mineral acids, such as HCl molar ratios above 1:1 should generally be avoided since, otherwise, a gel may form.

The emulsifier-dispersing agent (B) for the amidoamine fabric softener is one of the compounds of formula (II), (III), (IV) or (V).

The compounds of formula (II) and (III)

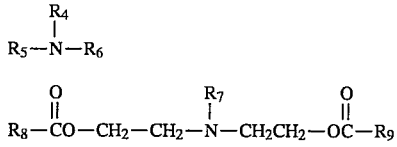

(II)

(III)

are mono- or di- higher fatty amines and dihigher fatty diester amines, respectively. Of these, the compounds of formula (II) are preferred. Examples of the hydrocarbon groups of from 8 to 22 carbon atoms for $R_4$, $R_8$ and $R_9$ are the same as described above for $R_1$ and $R_2$. Hydrogenated (hard) tallow is the preferred higher fatty group for $R_4$, $R_8$ and $R_9$. $R_5$ represents a hydrocarbon group, preferably alkyl or alkenyl of from 1 to 22 carbon atoms, and more preferably is either a lower alkyl of from 1 to 4 carbon atoms, such as methyl, ethyl, propyl, n-butyl, or tertbutyl, or a higher alkyl or alkenyl of from 8 to 22 carbon atoms, especially from 10 to 18 carbon atoms. The preferred higher alkyl or alkenyl group is tallow, and especially hydrogenated tallow. $R_6$ and $R_7$ represent lower ($C_1$–$C_4$) alkyl or hydroxyloweralkyl, such as, for example, methyl, ethyl, hydroxyethyl, propyl, hydroxypropyl, and so on.

Preferred examples of compounds of formula (II) include dimethyl hydrogenated (hard) tallow amine, available as Genamin SH-302D from Hoechst or Armeen DMHTD from AKZO; methyl dihydrogenated (hard) tallow amine, available as Genamin SH-301 and Armeen M2HT. Other representative compounds of formula (II) include hydroxyethyl ditallow amine, propyl di-coco-amine, methyl dioctyl amine, ethyl didodecylamine, methyldiheptadecyl amine, dimethyl tallow amine, dimethyl cocoamine, methyl ethyl dodecyl amine, diethyl heptadecyl amine, dimethyl octadecyl amine, etc.

Preferred examples of the compounds of formula (III) include

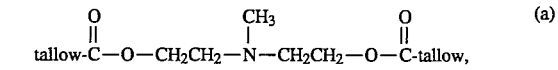

(a)

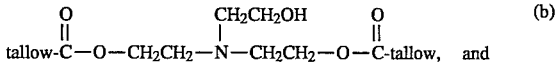

(b)

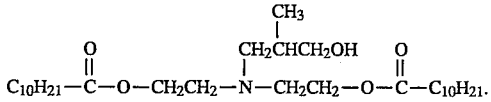

Of these, compound (a) is most preferred.

Compounds (IV) and (V) are diamino compounds, either linear or heterocyclic, containing one or two long chain fatty hydrocarbon substituents. Preferred examples for $R_{10}$ and $R_{14}$ are the same as given above for $R_4$; preferred examples for $R_{11}$ are the same as given above for $R_5$ and, especially hydroxy ($C_1$–$C_4$) alkyl group. Preferred examples of $R_{12}$, $R_{13}$ and $R_{15}$ are the same as given above for $R_6$ and $R_7$.

A specific example of a preferred compound of formula (IV) is N,N',N'-tris(2-hydroxyethyl)-N-tallow-1,3-diaminopropane, available from Armak as Ethoduomeen T13.

A specific example of a preferred compound of formula (V) is oleic imidazoline,

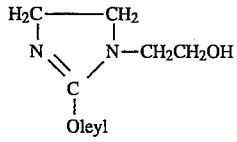

available as Varine O from Sherex.

The compositions of this invention are provided as aqueous dispersions in which the amidoamine fabric softener is present in finely divided form stably dispersed in the aqueous phase. Generally, particle sizes of the dispersed particles of less than 10 microns (mμ) on average are acceptable for both softening and stability insofar as the particle sizes can be maintained during actual use, typically in the rinse cycle of an automatic laundry washing machine. The lower limit is not particularly critical but from a practical manufacturing standpoint will not generally be below about 0.01 mμ, preferably at least about 0.05 mμ, a preferred particle size range of the dispersed ingredient being from about 0.1 to about 8 mμ.

The aqueous phase of the dispersion is primarily water, usually deionized or distilled water, with small amounts of co-solvent usually being present for adjustment of viscosity. Typically as the co-solvent lower mono- and poly-hydroxy alcohols and glycols will be used, generally in amounts up to about 8% by weight of the composition. The preferred alcohols and glycols are those having from 2 to 4 carbon atoms, such as, for example, ethanol, propanol, isopropanol, and propylene glycol or ethylene glycol. Isopropyl alcohol is especially preferred.

Other optional components commonly used in fabric softening compositions may be added in minor amounts to enhance either the appearance or performance properties of the liquid fabric softener compositions of this invention. Typical components of this type include, but are not limited to colorants, blueing agents, preservatives, germicides, and perfumes.

The subject liquid fabric softener compositions may be prepared by added the active ingredients, usually as a melt, to the heated aqueous phase to which the acid component has been pre-mixed, under mixing. Low-shear mixing is generally sufficient to adequately and uniformly disperse the active ingredients in and throughout the aqueous phase. Further particle size reduction can be obtained by subjecting the composition to further treatment such as in a colloid mill or by high pressure homogenization.

The final product, whether in concentrated or diluted form must be easily pourable by the end user. Generally, therefore, final product viscosity should not exceed about 2000 centipoise, preferably not more than 1000 centipoise, at room temperature but should not be less than about 50 centipoise. The preferred viscosity in the diluted or ready-to-use product is in the range of 120 to 200 centipoise. As used herein viscosity is measured by a Brookfield viscosimeter with Spindle #4 at 60 rpm.

For a concentrated product, the compositions may be formulated to be diluted by a factor of generally 4:1 or more, preferably up to about 8:1 or even 9 to 10:1. For the preferred hard-tallow ethoxylated amidoamine softener, Varisoft 510, concentrated products with up to about 12 weight percent of softener may be prepared and will remain stable against phase separation or suspended particle agglomeration for extended periods of time. Such concentrated products with 12 wt. % Varisoft 510 may be diluted up to about 4:1 and still provide equivalent softness at the same use level (e.g., about 110 ml for standard European washing machines) as a softener product containing 5 weight percent of ditallow (or distearyl) dimethyl ammonium chloride. For the more concentrated products, the more soluble soft-tallow ethoxylated amidoamine, e.g., Varisoft 512, should be used in place of part or all of the hard-tallow compound. After dilution, or for a ready-to-use product, the composition will normally contain sufficient softener to be effective when added to the rinse water in an amount of about one-eighth to three-quarters of a cup (1 to 6 ounces) providing about 25 ppm to about 90 ppm of softener in the rinse water.

In the above description and in the following examples and claims all parts and percentages are given on a weight basis unless otherwise stated.

EXAMPLE 1

In this example the improvement in softening efficacy and softener deposition in hard water using the invention compositions is demonstrated.

The following test emulsions were prepared:

| Ingredient | Amount (wt %) |
|---|---|
| Varisoft 510[1] | 5.0 |
| Emulsifier-dispersant | varied (0, 0.25, 0.5, 0.75, 1,0, 1.5) |
| $C_{16-18}$ alcohol | 1.0 |

-continued

| Ingredient | Amount (wt %) |
|---|---|
| Isopropyl Alcohol | 2.0 |
| Conc. HCl (37%) | 1.0 to 1.2 (to pH = 2.3) |
| Water, deionized | balance |

[1]bis(hydrogenated tallow amidoethyl)-2-hydroxyethyl amine.

The emulsions were prepared by the following procedure (for 600 grams of emulsion and 1% of emulsifier-dispersant):

Part I:

30 grams Varisoft 510

12 grams Isopropyl alcohol 6 grams emulsifier-dispersant 6 grams $C_{16-18}$ alcohol Part II:

540 grams deionized water 6.3 grams conc. HCl

Part I is melted and mixed in a 1 liter beaker. Part II is heated to 75° C. and poured into the Part I mixture while stirring with an overhead stirrer. 0.05 grams of anti-foaming agent (Dow Corning 1430) is added during mixing. The warm emulsion is then passed once through a high pressure homogenizer (Microfluidic Corp. M11T Microfluidizer) at 15000 psi. The particle size, measured using Brookhaven Light Scattering Instrument BI-2030 is 0.05 microns.

The softening evaluations were carried out on pretreated terry cotton fabric (Dundee 86% cotton, 14% polyester terry towels) with a variety of different surface characteristics obtained as follows:

1) Initial washes in U.S. machine. Wash in hot water, rinse in warm water.

1. 25 grams 60/40 soap chip/50 grams STPP.
2. 120 grams DyDamo® (a product of Colgate-Palmolive Co., nonionic detergent).
3. 25 grams 60/40 soap chip/50 grams STPP.
4. 120 grams Dynamo®. (STPP=sodium tripolyphosphate)

2) Mildly encrusted fabric. Washed in European (Miehle) washer at 200° F.

160 grams Gama® (a product of Colgate-Palmolive Co., nonionic determent)

42 grams $CaCH_2 \cdot 2H_2O$ (repeated 3×)

Fabrics line dried after each wash.

3) 6×Harshened. Miehle washer at 200° F.

84 grams STPP, 57 grams sodium sulfate, 19 grams sodium silicate; (6×).

Fabrics line dried after each wash.

In each run the test emulsion was used at a level to provide a final rinse concentration of 5.7 grams (as solids) in liters rinse water. The fabric treatments were carried out in a mini-softening cycle machine. The results are shown in the following Tables 1 and 2.

TABLE 1

Softening Efficacy and Softener Deposition on Encrusted Fabric At Varying Levels of Emulsifier-Dispersant

| | Test A: U.S. Tap Water | | | |
|---|---|---|---|---|
| Emulsifier:[2] | 0% T13 | 0.5% T13 | 1.0% T13 | 1.5% T13 |

TABLE 1-continued

Softening Efficacy and Softener Deposition on Encrusted Fabric At Varying Levels of Emulsifier-Dispersant

| | | | | |
|---|---|---|---|---|
| Softness | 6.2 | 7.3 | 8.6 | 8.4 |
| % Deposition | 87 | 92 | 94 | 90 |

Test B: 500 ppm $NaHCO_3$

| Emulsifier: | 0.5% T13 | 1.0% T13 | 1.5% T13 |
|---|---|---|---|
| Softness | 6.1 | 8.5 | 7.5 |
| % Deposition | 68 | 87 | 86 |

Test C: 500 ppm $NaHCO_3$/300 ppm $CaCl_2$

| Emulsifier: | 0.5% Varine O | 1.0% Varine O |
|---|---|---|
| Softness | 7.1 | 8.4 |
| % Deposition | 80 | 85 |

Test D: 500 ppm $NaHCO_3$/300 ppm $CaCl_2$ (No. C16–18 Fatty Alcohol)

| Emulsifier: | 0.5% T13 | 1.0% T13 |
|---|---|---|
| Softness | 8.4 | 7.8 |
| % Deposition | 80 | 90 |

Test E: 500 ppm $NaHCO_3$/300 ppm $CaCl_2$

| Emulsifier: | 1.0% T13 | 1.0% DMHTD |
|---|---|---|
| Softness | 8.4 | 7.8 |
| % Deposition | 80 | 90 |

TABLE 2

Softening Efficacy and Softener Deposition on Six Times Harshened Fabrics
Test F: 500 ppm $NaHCO_3$/300 ppm $CaCl_2$

| Emulsifier: | 0.25% T13 | 0.5% T13 | 0.75% T13 | 1.0% T13 |
|---|---|---|---|---|
| Softness | 8.0 | 8.2 | 8.9 | 8.2 |
| % Deposition | 88 | 92 | 93 | 91 |

[2]Ethoduomeen T13 (N,N',N'tris(2-hydroxyethyl-N-tallow-1,3-diaminopropane) (T13); Varine O (oleic imidazoline); Armeen DMHTD (dimethyl hard tallow amine)

Table 1 lists the softening results for mildly encrusted fabrics. Tests A, B and C clearly indicate that low levels of dispersant increase deposition and softening. Optimum softening on encrusted fabric at high water hardness was found at a use level of 1% for each dispersant tested. Removal of the $C_{16-18}$ fatty alcohol (Test D, Table 1)) reduces the level of dispersant necessary for maximum softening. Optimum softening was found at a use level of 0.5% (without the fatty alcohol) Ethoduomeen T13.

Fabric softening evaluations, on six times harshened fabric Table 2, demonstrate the influence of electrolyte on fabric softening efficacy. Six times harshened fabric did not introduce additional electrolyte into the rinse solution. Under the lower rinse electrolyte level a lower level of dispersant, 0.75% Ethoduomeen T13, was required for optimum softening by Varisoft 510 softener.

EXAMPLE 2

In this example, various emulsifier dispersants were evaluated to determine their stabilizing effects on Varisoft 510 dispersions. Systems were prepared as described below but without high pressure homogenization. Some emulsions were also evaluated for their softening performance.

Formula compositions and parameters

All the preparations contained 3% Varisoft 510, 0.2% HCl, 0.32% perfume (Douscent 653), colorant, preservative (KKM 446) and specified amounts of various emulsifier dispersants.

Mixtures of actives and perfume were added to the acidified aqueous phase (both at 70° C.) under stirring at 400 rpm (4-pitched blade impeller). Depending on their HLB, emulsifiers were either added in the aqueous phase or mixed with the active ingredients. After cooling down to 30° C. colorant and preservative were added.

pH and viscosity (Brookfield RVT at 50 rpm) were recorded both on freshly prepared emulsions and upon ageing for 1 week at room temperature (RT).

Particles size distributions were measured with a Malvern MasterSizer either directly after dilution of emulsions in deionized water (part. size init.) or 5 minutes after dilution in tap water to simulate a rinse bath (part. size Rinse).

Some softening evaluations were also carried out according to the standard procedures as described in Example 3. The results are report in Table 4.

The results are summarized in Table 3.

TABLE 3

| Run # | Emulsifier | Conc. % | HLB | Viscosity after 1 W (cps) | pH after 1 W | Visual[12] aspect after 1 W | Part. Size Init (μm) | Part. Size Rinse (μm) |
|---|---|---|---|---|---|---|---|---|
| V-1 | Synperonic[1] A2 | 0.45 | 5.9 | 1.2 | 2 | L | 8 | 17.4 |
| V-2 | Synperonic[1] A2 | 0.3 | 9.3 | 14 | 2 | L | | |
| | Synperonic[1] A20 | 0.15 | | | | | | |
| V-3 | Synperonic[1] A2 | 0.2 | 11.7 | 14 | 2 | LL | | |
| | Synperonic[1] A20 | 0.25 | | | | | | |
| V-4 | Synperonic[1] A2 | 0.1 | 13.9 | 15 | 2 | LL | | |
| | Synperonic[1] A20 | 0.35 | | | | | | |
| V-5 | Synperonic[1] A20 | 0.45 | 16.2 | 15 | 2 | LLL | 5.1 | 4.5 |
| V-6 | Genapol OX-030[2] | 0.45 | 8 | 13 | 2 | (L) | | |
| V-7 | Span[3] 85 | 0.45 | 1.8 | 12 | 2 | OK | | |
| V-8 | Span 65 | 0.45 | 2.1 | 11 | 2 | OK | 6.4 | |
| V-9 | GMS[4] | 0.45 | 3.8 | 13 | 2 | OK | 6.5 | 19.3 |
| V-43 | GMS | 0.45 | 3.8 | 11 | 1.86 | (S) | 0.7 | 24.3 |
| | HPH Process[5] | | | | | | | |
| V-10 | FATTY ALCOHOL[6] | 0.45 | | 15 | 2 | OK | 5.6 | 39.2 |

TABLE 3-continued

| Run # | Emulsifier | Conc. % | HLB | Viscosity after 1 W (cps) | pH after 1 W | Visual[12] aspect after 1 W | Part. Size Init (μm) | Part. Size Rinse (μm) |
|---|---|---|---|---|---|---|---|---|
| V-42 | FATTY ALCOHOL HPH Process | 0.45 | | 11 | 1.85 | S | 2.5 | 56 |
| V-10A | NONE | | | 12 | 1.6 | OK | 3 | 15.5 |
| V-34 | STEARIC ACID | 0.45 | | 24 | 1.8 | (S) | 7 | 11.7 |
| V-44 | STEARIC ACID HPH Process | 0.45 | | 12 | 1.8 | S | 1.35 | 55 |
| V-11 | Genamin[7] T-020 | 0.45 | 9.8 | 13 | 2 | LL | 5.9 | 9.2 |
| V-12 | Genamin[7] T-020 | 0.3 | 12.2 | 13 | 1.8 | LL | | 12.2 |
| | Genamin[7] T-200 | 0.15 | | | | | | |
| V-13 | Genamin[7] T-020 | 0.2 | 13.8 | 12 | 1.8 | LL | | |
| | Genamin[7] T-200 | 0.25 | | | | | | |
| V-14 | Genamin[7] T-020 | 0.1 | 15.4 | 12 | 1.9 | LL | | |
| | Genamin[7] T-200 | 0.35 | | | | | | |
| V-15 | Genamin[7] T-200 | 0.45 | 17 | 12 | 1.7 | LL | 4.4 | |
| V-16 | Genamin[7] S-020 | 0.45 | 10 | 13 | 2 | LL | | |
| V-17 | Genamin[7] O-020 | 0.45 | 9.9 | 12 | 1.9 | LL | | |
| V-18-A | Genamin SH-301[8] | 0.45 | | 36 | 1.8 | OK | | |
| V-18-B | Genamin SH-301[8] HPH Process | 0.45 | | 10 | 2.24 | OK | 0.4 | 7.7 |
| V-19 | Armeen M2HT[9] | 0.45 | | 46 | 1.8 | OK | 6.1 | 6.9 |
| V-20 | Armeen DMHTD[10] | 0.45 | | 12 | 2.1 | (L) | 4.6 | 6.5 |
| V-40 | Armeen DMHTD HPH Process | 0.45 | | 10 | 1.9 | S | 0.25 | 80 |
| V-18 | Ester Amine[11] | 0.45 | | 37 | 1.8 | OK | | 8.4 |
| V-53 | Ester Amine[11] | 0.3 | | 16 | 2.22 | OK | | 7.7 |
| V-52 | Ester Amine[11] | 0.2 | | 12 | 2.11 | OK | | 8.2 |
| V-51 | Ester Amine[11] | 0.1 | | 12 | 2 | OK | | 14.7 |
| V-54 | Ester Amine[11] | 0.05 | | 12 | 2.05 | OK | | 10.1 |

[1] $CH_3(CH_2)_{11/13}CH_2O(CH_2CH_2O)_nH$

A2: (n = 2)
A20: (n = 20)

[2] $CH_3(CH_2)_{10/13}CH_2O(CH_2CH_2O)_3H$

[3] Span 85: Sorbitantristearate
Span 65: Sorbitantristearate
[4] Glycerol monostearate
[5] High Pressure Homogenization
[6] $CH_3-(CH_2)_{14/16}-CH_2OH$
$(CH_2CH_2O)$

[7] $R_1-N$
$(CH_2CH_2O)_3$

T-020: $R_1$ = Tallow, m + n = 2
T-200: $R_1$ = Tallow, m + n = 20
S-020: $R_1$ = Stearyl, m + n = 2
O-020: $R_1$ = Oleyl, m + n = 2
[8] $(H-Tallow)_2N-CH_3$

[9] $(H-Tallow)_2N-CH_3$

[10] $H\text{-}Tallow\text{-}N-(CH_3)_2$

[11] $Tallow-\overset{O}{\overset{\|}{C}}-O-CH_2-CH_2-\overset{CH_3}{\overset{|}{N}}-CH_2CH_2-O-\overset{O}{\overset{\|}{C}}-Tallow$

[12] Visual aspect: (L)-LLL: Layering slight–strong
(S)-S: Sedimentation slight–moderate
OK-no visual layering or sedimentation

TABLE 4

| Run No. | Softening Evaluation-Range |
|---|---|
| V-9 | −0.3 to +0.3 |
| vs. | |
| DTDMAC (5%) | −0.3 to +0.3 |
| V-7 | −0.35 to 0 |

TABLE 4-continued

| Run No. | Softening Evaluation-Range |
|---|---|
| vs. | |
| DTDMAC (5%) | −0.10 to +0.35 |
| V-18-A | 0 to +0.45 |
| vs. | |

TABLE 4-continued

| Run No. | Softening Evaluation-Range |
|---|---|
| DTMAC (5%) | −0.5 to 0 |
| V-20 | −0.3 to +0.1 |
| vs. | |
| DTMAC (5%) | −0.15 to +0.25 |

From Tables 3 and 4 the following observations and conclusions can be drawn.

o Ethoxylated fatty amines (Genamin 2 or 20 EO, HLB range from 9.8 to 17) individually and as mixtures fail to stabilize the Varisoft formulas: an obvious layering appears in all the cases, even after 24 h at RT.

o Dimethyl fatty amine (Armeen DMHTD) is more efficient in stabilizing the Varisoft emulsion: nevertheless a slight layering appears after 1 week at RT.

o Methyl difatty amine (Genamin SH 301 or Armeen M2HT) seems to be the most efficient stabilizer; formulas remain fully acceptable after several weeks at RT.

o The softening performance of methyldifatty amine (SH-301, M2HT) containing emulsion is equivalent in softening to a DMHTD containing emulsion (which is known to be equivalent to 5EQ).

o Apparently nonionics with low HLB (<4) can stabilize Varisoft emulsions: good results were obtained with Span, GMS or fatty alcohol. However, the softening performances of these nonionic containing formulas are significantly inferior to DMHTD containing emulsions.

o Nonionics with higher HLB values (>5) (Synperonics and Genapol) did not prevent layering of the Varisoft emulsion.

o The concentration of methyl dihigher fatty amine (Genamin SH-301) can be reduced down to 0.05% without affecting the stability of the Varisoft emulsion (at least after 1 week at RT). Moreover a softening test demonstrated equivalent performances for Varisoft emulsions containing either 0.45% or 0.05% of methyl dihigher fatty amine.

EXAMPLE 3

From Example 2, Run Nos. V-9 vs. V-48, V-10 vs. V-42, V-34 vs. V-44, V-20 vs. V-40, it is observed that in many cases, subjecting the formula to further particle size reduction results in particle size agglomeration in the rinse water and lessening of stability (cf. V-18-A and V-18-B wherein the HPH processing did not adversely affect stability). In this Example, it is shown that subjecting the composition to high pressure homogenization to reduce particle size has no or little effect on softening performance, at least for a freshly prepared composition in which the particle size is below about 10 microns (mμ).

Emulsions were prepared with the amidoamine (Varisoft 510) with or without addition of fatty alcohol or emulsifier/stabilizer). Formulations B-1, B-2 and B-3 (Table 5) were prepared by adding the molten softener/other active ingredients to hot, acidified water while mixing with a low-shear overhead stirrer. Formulations K-1, K-2 and K-3 (Table 5) were prepared in the same way but then subjected to further treatment with a high pressure homogenizer, M11T Microfluidizer, at 15,000 psi.

TABLE 5

| | Run No. (wt %) | | |
|---|---|---|---|
| Formula | B-1 & K-1 | B-2 & K-2 | B-3 & K-3 |
| Amidoamine (Varisoft 510) | 5% | 5.0 | 3.0 |
| Emulsifier/Stabilizer | — | 0.75[1] | 0.45[2] |
| $C_{16/18}$ alcohol | — | 1.0 | — |

[1]Tallow propyldiamine (3EO)
[2]Tallow dimethyl amine

Particle size measurements were made with a Malvern Master Sizer. The results are reported in Table 6. Softening evaluations were made by the following procedure:

The test fabric is the 6× harshened fabric prepared as described in Example 1. Such hardening is effective to simulate hardening effects on laundry that are encountered in normal laundry operations and to accentuate differences between softening agents employed, and has been found to so do consistently.

To compare two fabric softening compositions for softening action nine tests are run on each of such compositions, using 40 cm×40 cm hardened terry cloth swatches and rinsing each of them in rinse waters containing either fabric softening composition. Evaluation of softening actions (or softness of the treated swatches) are made by six judges in blind comparison tests. These tests are carried out using a specially designed reduced scale rinsing apparatus. The rinsings are made in tap water (water hardness about 300 ppm CaCO3) containing 0.44% by weight of the softening composition; the volume of rinse is 833 ml per 100 g of dry terry cloth. After rinsing, the swatches are air dried in a temperature- and humidity-controlled room, while being maintained horizontal to prevent loss of the fabric softener from the fabric due to dripping. After drying the swatches are ready for softness evaluation by the panel of six judges.

The judges rate the swatches for softness by comparing them to each other. In the comparison step, judges evaluate each of the nine swatches treated with one product (P) with the corresponding swatch treated with the reference (R), i.e. P1 vs R1; P2 vs R2; . . . P9 vs R9. The judges evaluate the relative softness by giving a rating from 0 (equivalence) to ±(very high difference) to the softest swatch. After the statistical treatment of the results (variance analysis) means scores are obtained for each product. The difference between these scores correspond to the average rating given by the judges. For instance if scores are P=+0.5 and R=−0.5, the difference between R and P is 1, which correspond to a slight but perceivable difference between the softness imparted by the two products. The judges ratings are evaluated, using statistical techniques, and final results show whether the softening compositions are equal in softening actions or whether one or the other is significantly better. More specifically, the arithmetic mean of the scores for each product is calculated and the confidence interval of this mean (i.e., the zone where there are 95 chances out of 100 to find the correct mean) statistically determined. When there is no overlap of confidence intervals between the two products, it can be said that the two products are significantly different. The results (upper and lower values of the confidence intervals) are shown in Table 6 as the softening performance.

TABLE 6

| Run No. | Particle Size (mμ) | Softening Evaluation |
|---|---|---|
| B-1 | 9.8 | −0.5 to +0.25 |
| K-1 | 0.42 | −0.25 to +0.50 |
| B-2 | 1.6 | −0.3 to +0.1 |
| K-2 | 0.34 | −0.2 to +0.4 |
| B-3 | 4.6 | −0.05 to +0.5 |
| K-3 | 0.25 | −0.50 to 0 |

From the results reported in Table 6 it is seen that there was at least a small overlap in each case indicating that there was no perceived significant difference in the comparative softening performance of compositions subjected to low shear mixing and equivalent compositions subject to high pressure homogenization.

EXAMPLE 4

This example demonstrates the effectiveness in softening performance of compositions based on mixtures of Varisoft 510 (hard(H)-tallow amidoamine) and Varisoft 512 (soft-tallow amidoamine).

The following formulations were prepared:

| | A | B |
|---|---|---|
| | amount (wt %) | |
| Varisoft 510 | 2.75 | 5.00 |
| Varisoft 512 | 0.50 | 0.75 |
| Isopropyl alcohol | 2.00 | 2.00 |
| HCl (37%) (to provide 1:1 molar with amines) | 0.47 | 0.97 |
| Deionized Water | 94.28 | 91.28 |

The order of addition has been found to be important in preparation of these compositions. An acidic water phase is first prepared and after heating is added to the melted oil phase under stirring until the system has cooled. The following procedure was used to prepare 600 grams of Formula A:

Part I:

16.5 grams Varisoft 510 (100% AI)

12.0 grams Isopropyl Alcohol 3.3 grams Varisoft 512 (92% AI)

Melt and mix in a 1 Liter beaker.

Part II:

565.0 grams deionized water 2.8 grams concentrated hydrochloric acid Heat Part II to 70° C. Pour Part II into melted Part I while stirring with an overhead stirrer. Add 0.05 grams Dow Corning 1430 antifoam. Continue to stir until emulsion cools to room temperature. Add deionized water to bring to correct total weight. Mix gently.

The same procedure was used to prepare 600 grams formula B emulsion except that the amounts were changed as follows:

| | | amt (gm) |
|---|---|---|
| Part I: | Varisoft 510 | 30.0 |
| | Isopropyl alcohol | 12.0 |
| | Varisoft 512 | 4.5 |
| Part II: | Water, deionized | 547.0 |

-continued

| | amt (gm) |
|---|---|
| HCl (37%) | 5.8 |

To determine the "product activity" of these softening compositions relative to conventional quat softener the softening test procedure described above in Example 3 is used with one of the tested products being a reference, i.e., a dispersion of a known concentration of pure Di-Tallow Di-Methyl Ammonium Chloride (DTDMAC, also known as Quat). Evaluations with different concentrations (wt %) of DTDMAC are carried out until an equivalence (EQ) between the two products is found. Then the "product activity" of the tested composition in terms of the conventional Quat (DTDMAC) concentration needed to deliver the same softness as the tested product under the standard test conditions is determined.

Formula A had a rating of 5EQ (i.e., equivalent to 5 wt % Quat) whereas Formula B had a rating of 11EQ (i.e., equivalent to 11 wt % Quat). Generally, softening compositions of at least 5EQ softness rating are considered commercially acceptable.

EXAMPLE 5

This example shows the preparation of two concentrated compositions containing amounts of softening and stabilizing active ingredients to provide dilution ratios of 4:1 or 8:1.

| | A (4:1) weight % | B (9:1) weight % |
|---|---|---|
| Varisoft 512 (100% active) | 20.0 | 44.9 |
| Armeen DMHTD | 3.0 | 6.6 |
| Isopropyl alcohol | 4.0 | 6.6 |
| Neutralizing acid | 1.46 (HCl) | 27.1 (glycolic acid) |
| Calcium chloride (22% solution) | 0.8 | — |
| Dow 1430 Antifoam | 0.2 | 0.1 |
| Fragrance | — | 2.0 |
| water | 70.54 | 12.7 |
| | 100.0 | 100.0 |

These compositions remain stable for more than 3 months and are pourable at room temperature. These concentrated compositions are prepared similarly to the procedure described in Example 4. Specifically Emulsion A was prepared by melting together the Varisoft 512, isopropyl alcohol, and Armeen DMHTD. This mixture was added in 4 parts to the hydrochloric acid water mixture previously heated to 70° C. After each addition of the amine mixture, the viscosity was adjusted by the addition of small amounts of 22% $CaCl_2$ solution. The emulsion was stirred until cool. The final viscosity could be adjusted by addition to additional $CaCl_2$ within the range of 70–1000 cps. Upon dilution with tap water the emulsion viscosity was 20 cps. Emulsion B was prepared by first heating 0.7% water with the glycolic acid until melted/dissolved. The isopropyl alcohol was then added. The Varisoft 512 and Armeen DMHTD were added and the system heated and mixed until all components were melted together. The fragrance and antifoam were then added. While mixing the remaining 12% water was added as hot tap water. The concentrate on cooling was a pourable 600 cps emulsion. Upon dilution with room temperature tap water, a product was prepared which although initially viscous stabilized at 20 cps. Higher viscosities will be obtained by replacing all or part of Varisoft 512 with Varisoft 510.

Softening evaluation of the 4:1 diluted concentrate A was carried out in the minisoftening cycle machine. Rinse water contained 500 ppm $NaHCO_3$ and 330 ppm $CaCl_2$. The diluted 4:1 emulsion was used at a level of 110 grams/25 L and fabric at a level of 3Kg/25 L. On the 10 (softest) to 1 (harshest) versus an imidazole ester as described in U.S. Pat. No. 5,116,520

| | |
|---|---|
| imidazole ester | 9.0 |
| 4:1 Concentrate | 8.6 |

For the 9:1 diluted concentrate B the softening performance versus the commercially available product containing the imidazole ester was

| | |
|---|---|
| imidazole ester | 9.1 |
| 9:1 Concentrate | 8.7. |

Similar results are achieved using HCl in Emulsion B place of glycolic acid and vice versa. These compositions provide better softening performance than compositions containing equivalent amount of conventional quat softener, and specifically have an EQ rating of about 10 when diluted to about 5.7% solids.

EXAMPLE 6

This example shows that not all additive/stabilizers are effective to promote softening performance of the amidoamine fabric softener.

Following the procedure of Example 4A but replacing Varisoft 512 with an equivalent amount of myristic acid, sucrose distearate, or $C_{16-18}$ fatty alcohol, the softness rating (on a scale of 1 to 10, 10 being the highest) was the same as without any stabilizer (8.0) whereas the composition of Example 4A had a softness rating of 8.5.

The above examples demonstrate that both high levels of storage stability and softening performance are provided by the compositions of this invention. More specifically, it has been shown that by appropriate modification of the chemical composition the full softening performance of the amidoamine fabric softening compounds are achieved even when used in hard water and in the presence of added electrolyte from calcium salt encrusted fabric.

We claim:

1. A stable, aqueous, pourable and water dispersible fabric softener composition comprising:

(A) a fabric softening effective amount of an inorganic or organic acid salt of a finely divided less than about 10 microns, fabric softening compound of formula (I):

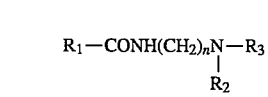

(I)

wherein $R_1$=$C_{12}$ to $C_{30}$ alkyl or alkenyl, $R_2$=$R_1CONH(CH_2)_m$, $R_3$=$(CH_2CH_2O)_pH$, n=1 to5, m=1 to 5, and p=1 to 10;

(B) a dispersant stabilizing effective amount of a dispersant having the formula (II), (V) or (IV):

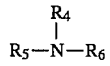

(II)

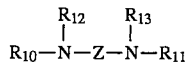

(IV)

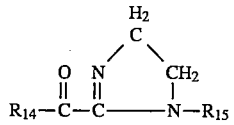

(V)

wherein $R_4$ represents a hydrocarbon group having from 8 to 22 carbon atoms, $R_5$ represents a hydrocarbon group having from 1 to 22 carbon atoms, $R_6$ represents $C_1$–$C_4$ alkyl or hydroxyalkyl, $R_{10}$, independently, represent a hydrocarbon group having from 8 to 22 carbon atoms, $R_{11}$ represents a hydrocarbon group having from 1 to 22 carbon atoms which may have an hydroxyl group substituent, $R_{12}$ and $R_{13}$, independently, represent $C_1$–$C_4$ alkyl or hydroxyalkyl, $R_{14}$ represents a hydrocarbon group having from 8 to 22 carbon atoms, $R_{15}$ represents a hydrogenation or $C_1$–$C_4$ alkyl or hydroxyalkyl, and Z represents a divalent alkylene group of from 1 to 6 carbon atoms which may include a hydroxyl group; and (C) an aqueous solvent wherein the pH of the composition ranges from 1.5 to 4.0 and wherein the composition is substantially free of quaternized compounds.

2. The fabric softener composition of claim 1 wherein in the compound of formula (I), $R_1$=$C_{16}$ to $C_{22}$ alkyl, $R_2$=$R_1CONH(CH_2)_m$, m=1 to 3, n=1 to 3

$R_3$=$(CH_2CH_2O)_pH$, and p=1.5 to 3.5.

3. The composition of claim 1 wherein the weight ratio of (A):(B) is in the range of from about 10:1 to about 1.5:1.

4. The composition of claim 3 wherein the total amount of (A) and (B) ranges from about 2 to 10% by weight based on the total composition.

5. The composition of claim 3 wherein the total amount of (A) and (B) ranges from about 12 to 60% by weight based on the total composition.

6. The composition of claim 1 wherein the aqueous solvent comprises water and up to about 8%, based on the total composition, of a lower alkanol of from 2 to 4 carbon atoms.

7. The fabric softening composition of claim 1 which further comprises up to about 2% by weight of a $C_{12}$ to $C_{24}$ fatty alcohol.

8. The fabric softening composition of claim 1 which comprises:

(A) from about 2 to 8% by weight of a salt of bis(hydrogenated tallow amidoethyl)-2-hydroxyethyl amine;

(B) from about 0.2 to 1.5% by weight of a compound selected from the group consisting of N,N'N'-tris(2-hydroxyethyl)-N-tallow- 1,3-diaminopropane, dimethylhydrogenated tallow amine, methyl dihydrogenated tallow amine and oleic imidazoline;

(C) from about 0.5 to 5% of $C_2H_5OH$ or $C_3H_7OH$, or mixtures thereof;

(D) from 0 to about 2% of $C_{16}$ to $C_{18}$ fatty alcohol; and (E) from about 87 to 94% water, said composition having a pH of less than 4.

9. The fabric softening composition of claim 8 wherein the salt of bis(hydrogenated tallow amidoethyl)-2-hydroxyethyl amine has a particle size of from 0.05 to 10 microns.

10. The fabric softening composition of claim 8 wherein the salt of bis(hydrogenated tallow amidoethyl)-2-hydroxyethyl amine is the HCl, $H_2SO_4$, acetic acid, propionic acid, lactic acid, citric acid or glycolic acid salt, or mixtures thereof.

11. The fabric softening composition of claim 10 wherein the salt is the HCl or glycolic acid salt, or mixture thereof.

12. The fabric softening composition of claim 10 wherein the acid is present in a molar ratio of 0.5:1 to 6:1 relative to the amidoamine compounds.

13. A liquid fabric softening composition comprising an aqueous dispersion of from 2 to 50% by weight, (A') an inorganic or organic acid salt of bis(hydrogenated tallow amidoethyl) hydroxyethyl amine, and (B') an inorganic or organic acid salt of bis(non-hydrogenated tallow amidoethyl) hydroxyethyl amine, at a weight ratio of (A'):(B') of from 10:1 to 1.5:1 wherein the pH of the composition ranges from 1.5 to 4.0 and wherein the composition is substantially free of quaternized compounds.

14. The composition of claim 13 which further comprises from about 1 to 8% by weight of an alkanol or glycol having either 2, 3 or 4 atoms.

15. The composition of claim 13 comprising from 2 to by weight of (A') and (B') combined.

16. The composition of claim 13 comprising from 12 to by weight of (A') and (B') combined.

17. A method of imparting softness to fabrics comprising contacting the fabrics with a softening effective amount of the fabric softener composition of claim 1.

18. The method of claim 17 wherein said contacting is in the rinse cycle of an automatic laundry washing machine.

19. A method of imparting softness to fabrics comprising contacting the fabrics with a softening effective amount of the fabric softener composition of claim 13.

20. The method of claim 19 wherein said contacting is in the rinse cycle of an automatic laundry washing machine.

* * * * *